United States Patent [19]

Matesco

[11] Patent Number: 4,540,912

[45] Date of Patent: Sep. 10, 1985

[54] SPARKING-PLUG

[75] Inventor: Michel G. P. Matesco, Moingt Montbrisson, France

[73] Assignee: Eyquem, Manterre, France

[21] Appl. No.: 311,654

[22] Filed: Oct. 15, 1981

[30] Foreign Application Priority Data

Oct. 17, 1980 [FR] France ..... 80 22227

[51] Int. Cl.[3] ..... H01T 13/20

[52] U.S. Cl. ..... 313/142; 313/143

[58] Field of Search ..... 313/137, 142, 143

[56] References Cited

U.S. PATENT DOCUMENTS

| | | | |
|---|---|---|---|
| 1,441,444 | 1/1923 | Mitchell . | |
| 2,069,320 | 2/1937 | McKone | 123/169 |
| 2,080,495 | 5/1937 | McKone | 123/169 |
| 2,106,449 | 1/1938 | Boyd | 123/169 |
| 2,296,033 | 9/1942 | Heller | 313/137 |
| 3,317,774 | 5/1967 | Hamilton | 313/143 |

FOREIGN PATENT DOCUMENTS 161327 4/1921 United Kingdom .

*Primary Examiner*—William L. Sikes
*Assistant Examiner*—Robert E. Wise
*Attorney, Agent, or Firm*—Cushman, Darby & Cushman

[57] ABSTRACT

This sparking-plug for an internal combustion engine having a controlled ignition comprises a device for evacuating the heat of the earth electrode, the heat of the center electrode and the heat of the end of the nose of the insulator of the center electrode. This end of the nose of the insulator projects into the combustion chamber of the engine in which it is partly exposed to the flame front of the combustion and partly masked off by said device. The device constitutes a massive support for the earth electrode.

9 Claims, 7 Drawing Figures

SPARKING-PLUG

DESCRIPTION

The present invention relates to sparking-plugs for internal combustion engines the ignition of which is controlled.

One of the efforts on the part of sparking-plug manufacturers is to try to increase the service life of the sparking-plugs while ensuring the ignition under the best conditions.

Sparking-plugs employed at the present time comprise a screwthreaded barrel by means of which the sparking-plug is screwed into an aperture in the cylinder-head of an engine, a ceramic body fixed to the barrel and in which is disposed a centre electrode insulated from the barrel, and an earth electrode which is connected to the barrel, the centre electrode being connected to an outer terminal or screw employed for effecting an outer connection.

The life of sparking-plugs employed at the present time is mainly limited by the deterioration and soiling or oiling-up of the electrodes and of the nose of the insulator. It has been found that this deterioration, which, in most configurations of present-day combustion chambers, essentially affects the earth electrode, is related to various factors such as the temperature, the disposition of the valves, the composition of the fuel, the timing of the engine and other factors, while the soiling occurs mainly at low engine running speeds and at low temperature.

Further, there must be added to these usual factors of electrode wear, on one hand, the presence of lead additives in the fuels employed at the present time which result in a severe oiling-up and corrosion of the electrodes and of the insulator nose and a rise in their temperature, and, on the other hand, the weakening of the mixture for reasons of economy which also increases the temperature in the region of the electrodes and consequently facilitates the corrosion.

At low running speeds, for example when the vehicle provided with the engine travels in towns, the temperature of the centre electrode and of the nose of the insulator is not high enough to cause the pyrolysis of the carbon deposits the accumulation of which results in missfiring and consequently a defective operation of the engine.

At high running speeds, if the temperature is excessively high, there results the well-known phenomenon of pre-ignition which has a destructive effect on the engine.

It has been found that the minimum temperature below Which soiling occurs is 500° C. whereas the maximum temperature above which the pre-ignition occurs is 800°–850° C.

Consequently, in order to prolong the life of a sparking-plug while ensuring that the ignition occurs in such manner as to result in maximum efficiency of the engine, it is essential, on one hand, to ensure a good dissipation of the heat of the electrodes in operation, and, on the other hand, to provide a suitable arrangement for avoiding the soiling of the electrodes and of the nose of the insulator, ie. to achieve a self-cleaning by a pyrolysis effect while maintaining the temperature of the electrodes within the range of from 500° to 800° C.

Various attempts have been made up to the present time to achieve these results, but the various envisaged arrangements have not achieved these two objects in a completely satisfactory manner.

Most sparking-plugs,up to recently, comprise a barrel whose edge extended uniformly beyond the nose of the insulator of the centre electrode and even, in some types of sparking-plugs, beyond the end of this electrode.

In these sparking-plugs, there is obtained a relatively low temperature of the nose of the insulator at low running speeds. This has the drawback of resulting in a rapid and considerable soiling.

In another type of sparking-plug, which tends to become generalized, the nose of the insulator of the centre electrode projects beyond the edge of the barrel and thus exposes the latter and the centre electrode to the front of of the flames of the combustion chamber.

In this way the temperature of pyrolysis of the carbon depots is easily reached. However, in the region of the nose of the insulator, the mean temperature of operation is high and thus facilitates the corrosion of the active part.

As concerns the cooling of the centre electrode, this is rather satisfactory in sparking-plugs whose barrel extends beyond the nose of the insulator.

In sparking-plugs in which the nose of the insulator extends beyond the barrel, the earth electrode, which is necessarily longer, is imperfectly cooled and very rapidly corrodes.

U.S. Pat. No. 1,441,444 discloses a sparking-plug comprising a barrel which extends beyond the nose of the insulator and moreover includes two small ears between which extends a diametral electrode whose heat, which is high enough to ensure the carbonization of the deposits, is partly evacuated by the ears of the barrel.

However, in such a sparking-plug, the nose of the insulator and the centre electrode are completely masked by the barrel, by the ears thereof and the large-section earth electrode and are consequently liable to become considerably soiled which is moreover practically impossible to eliminate by a cleaning of this sparking-plug when the latter is withdrawn from the cylinder-head of the engine.

An object of the invention is to overcome these various drawbacks by providing a sparking-plug in which the nose of thc insulator of the centre electrode is maintained within the appropriate temperature range and the temperature of the earth electrode is markedly lowered in operation, this sparking-plug having excellent self-cleaning properties by pyrolysis while permitting a cheap manufacture thereof.

The invention provides a sparking-plug for an internal combustion engine having a controlled ignition, said sparking plug comprising means for evacuating both the heat of the earth electrode, the heat of the centre electrode and the heat of the end of the nose of the insulator of the centre electrode, said end projecting into the combustion chamber in which it is partly exposed to the flame front and is partly masked therefrom by said means, the latter constituting a support for the earth electrode.

Further features and advantages of the invention will be apparent from the ensuing description with reference to the accompanying drawings which are given solely by way of example and in which.

In the various Figures of the drawing like parts are designated by like reference characters.

Figure 1:
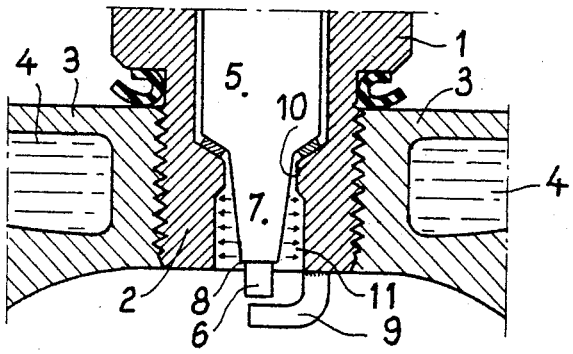
FIG. 1 is a partial sectional view of a sparking-plug of the prior art.

FIG. 1 shows in section a sparking-plug of the prior art which comprises a body 1 having a screwthreaded barrel 2 screwed in the cylinder-head 3 of an engine which is cooled in a conventional manner by water-circulating means 4.

An insulating body 5 surrounds the centre electrode and fixes the latter in the body 1. The end of the centre electrode projects from the end 8 of the nose 7 of the insulator 5.

An earth electrode 9 is fixed to the edge of the barrel 2 and extends radially in front of the end 6 of the centre electrode in the known manner.

The barrel 2 comprises internally a shoulder 10 for centering and maintaining the insulating body 5.

Beyond this shoulder, the inner surface of the barrel 2 of larger diameter defines with the nose 7 an annular space 11.

The end 8 of the nose 7 extends axially to a position slightly inwardly offset with respect to the edge of the barrel 2.

In operation, the maximum temperature of the cooling Water being 100° C., the temperature of the part of the cylinder-head in contact with the barrel is about 200° C.

The active part of the sparking-plug formed by the end 8 of the nose 7 of the insulator, the end 6 of the centre electrode and the earth electrode, has in operation at full running speed a temperature of the order of 800° to 850° C.

The Applicant has found that in such a sparking-plug the heat of the nose 7 of the centre electrode 6 is dissipated, on one hand, by conduction in the region of the body 5 and, on the other hand, by radiation as indicated by the arrows in the cold wall of the barrel the mass of which is maintained at a considerably lower temperature owing to its contact with the cylinder-head.

This dissipation is so effective that the nose of the insulator has a relatively low temperature at low running speeds of the engine and much lower than 500° C. at idling speed.

Consequently, such a sparking-plug soils up relatively rapidly and the carbon deposits accumulated in the annular space surrounding the nose 7 and produce ignition defects by a short-circuit effect.

Figure 2:
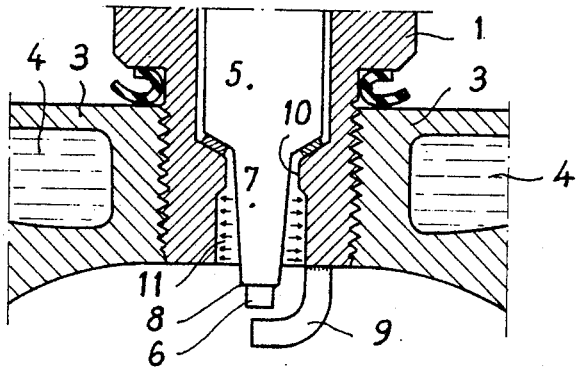
FIG. 2 is a view similar to FIG. 1 of another known type of sparking-plug.

FIG. 2 is a view similar to FIG. 1 of a sparking-plug of another known type which differs from the sparking-plug just described in that the nose 7 of the insulator extends axially beyond the edge of the barrel 2 so that a part of its end 8 projects into the combustion chamber where it is exposed to the flame front of the combustion.

The heat of the main part of the nose 7 within the barrel 2 is evacuated, as in the preceding example, partly by conduction with the body 1 and to a lesser extent by radiation, as indicated by the arrows in the barrel 2.

The active parts, ie. the end 8 of the nose and the end of the centre electrode 6, do not soil up as they are maintained at a very high temperature by the combustion which burns the deposits.

On the other hand, the temperature of operation is excessively high since the heat of the end 8 and of the electrode 6 is unable to be dissipated by radiation as no cold part is in the vicinity.

This type of sparking-plug has poor corrosion resistence properties.

Figure 3:
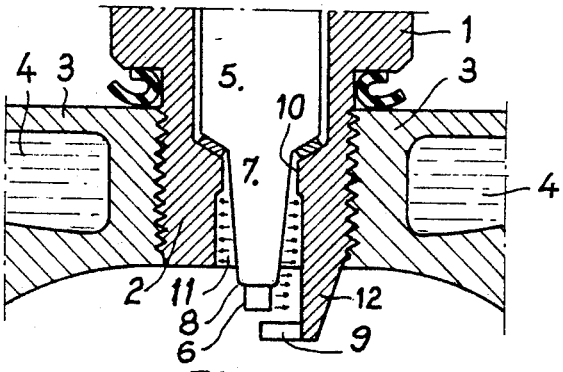
FIG. 3 is a similar view of an embodiment of a sparking-plug according to the invention.

FIG. 3 shows a sparking-plug according to the invention which comprises means for dissipating both the heat of the nose of the insulator and of the end 6 of the electrode throughout the length of the length thereof by radiation, and the heat of the earth electrode by conduction, while the end 8 of the nose of the insulator and the end 6 of the centre electrode are partly exposed to the flame front of the combustion chamber since they project into the latter.

These means comprise a massive extension 12 which is rigid with the edge of the barrel 2 and extends the latter axially at least to the region of the end 6 of the centre electrode while constituting both a cold massive support for the earth electrode 9 and a cold wall partly surrounding the centre electrode and the nose of the insulator.

Preferably, the massive supporting extension 12 extends axially from an arc of the periphery of the edge of the end of the barrel 2 which is between 60° and 120° and preferably equal to one quarter of the circumference.

The earth electrode 9, formed by a conventional small bar of nickel alloy employed for earth electrodes of sparking-plugs, is fixed by one end thereof to the inner surface of the support 12 in the vicinity of the end of the centre electrode 4 at a desired distance from the latter, namely about 6/10th of a millimeter.

The support 12 may either be in one piece with the edge of the barrel as manufactured, by machining, cold-stamping or some other suitable method, or be formed separately and secured to the edge of the barrel, for example by welding.

Its thickness is appropriately substantially equal to the thickness of the part of the barrel extended thereby, Which facilitates its cheap production, for example by stamping as mentioned above. Consequently, the support 12 is, in operation of the sparking-plug, at roughly the same temperature as the barrel, so that the mass of the support and the mass of the barrel when cold act as a heat dissipator for the earth electrode carried thereby whose volume is small relative to the volume of the earth electrode of a conventional sparking-plug owing to this arrangement.

The support 12 constitutes also a cold wall which extends in front of the nose of the insulator and of the centre electrode in a sufficient part of their periphery to absorb and dissipate the heat given off by the nose and the electrode by radiation.

There is thus obtained, on one hand, a marked lowering of the temperature of the earth electrode 9 which is consequently much less liable to corrode and, on the other hand, an appropriate cooling of the centre electrode and of the nose of the insulator which remain moreover partly exposed to the flames of the combustion to an extent sufficient to maintain them between 500° and 800° C. and ensure the cleaning thereof by a pyrolysis effect.

Figure 4:
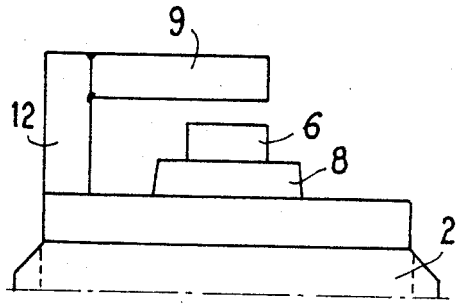
FIG. 4 is a partial diagrammatic side elevational view of the end of the barrel of a sparking-plug according to the invention.
Figure 5:
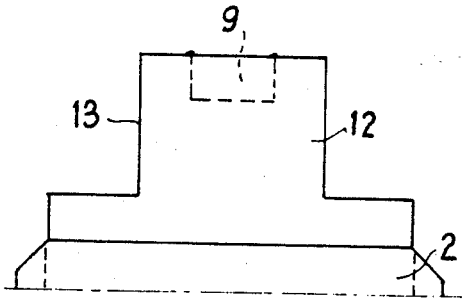
FIG. 5 is a view at 90° to the view of FIG. 4 in the direction of arrow 1 showing the shape of the projecting portion of the barrel on which the earth electrode is fixed.

In the embodiment shown more diagrammatically in FIGS. 4 and 5, the support 12 has two lateral edges 13 which are roughly vertical and perpendicular to the end edge of the barrel 2.

Figure 6:
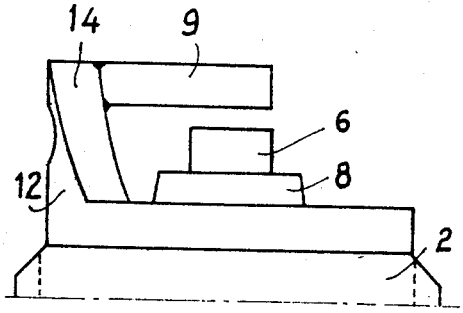
FIGS. 6 and 7 are views similar to FIGS. 4 and 5 respectively of a second embodiment.
Figure 7:
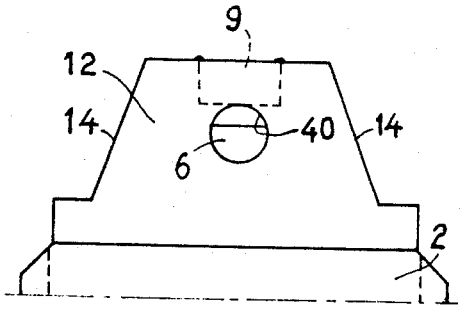

In the embodiment shown in FIGS. 6 and 7, the support 12 has two inclined lateral edges 14 so that, in this embodiment, the support 12 has the shape of an isosceles trapezium in elevation as shown in FIG. 7.

It can be seen that in the two embodiments described hereinbefore, the earth electrode 9 does not extend beyond the end of the support 12 in the axial direction, its position being shown in dotted linesin FIGS. 5 and 7.

In the various embodiments, the mass or volume of the electrode 9 is much less than that of the support 12 and consequently the latter constitutes a good heat dissipator which lowers the temperature of the earth electrode in operation of the sparking-plug.

The Applicant has found that sparking-plugs such as those described hereinbefore do not disturb the mixture in the combustion chamber and that their electrodes are well exposed to the flame front and consequently are well cleaned by the pyrolysis effect. Further, the temperature of the active parts is maintained within the optimum range.

Without having an adverse effect on the transfer of heat between the nose of the insulator and the barrel 2 by way of the support 12, the latter may be provided with an aperture 40 which extends therethrough just below the electrode 9, as shown in FIG. 7. This ensures a still better licking of the end 6 of the centre electrode by the flames without adversely affecting the transfer of heat by radiation, this radiation occurring mainly in the region of the nose of the insulator.

It will be understood that the invention not only lowers the temperature of the electrodes in operation of the sparking-plug, but also has self-cleaning properties by the effect of pyrolysis, with minimum production cost, and consequently provides a sparking-plug whose life is very considerably prolonged with respect to conventional sparking-plugs.

Having now described my invention, what I claim as new and desire to secure by Letters Patent is:

1. A sparking-plug for a combustion chamber of an internal combustion engine having a controlled ignition, and where a flame front develops in the combustion chamber, said sparking-plug comprising a barrel, a center electrode, an earth electrode, an insulator for the center electrode, said insulator having a nose, means for removing heat from said earth electrode, from the center electrode and from the end of said nose of said insulator, said end being disposed relative to said barrel to project into said combustion chamber wherein said end will be partly exposed to the flame front and will be partly masked off from said flame front by said means for removing the heat, said means for removing the heat inclduing earth electrode heat removal means for projecting into said chamber and only partially surrounding said center electrode, said heat removal means comprising an extension of said barrel, said extension constituting a relatively massive support for said earth electrode and being formed integrally with said barrel in the manufacture of said barrel, said support extending axially from an edge of said barrel at least to the outer end of said center electrode and partly surrounding said center electrode on an arc which subtends an angle of substantially between 60° and 120° at the center of the sparking-plug and with the earth electrode extending radially and rectilinearly from the end of said support.

2. A sparking-plug according to claim 1, wherein said massive support is in one integral piece with the barrel as manufactured.

3. A sparking-plug according to claim 1, wherein said massive support is constructed separately and means fix the massive support to the end edge of the barrel.

4. A sparking-plug according to claim 3, wherein said fixing means comprise welding.

5. A sparking-plug according to claim 1, wherein the earth electrode is fixed by one end thereof to the inner surface of the support.

6. A sparking-plug according to claim 1, wherein the massive support comprises rectilinear lateral edges perpendicular to the end edge of the barrel.

7. A sparking-plug according to claim 1, wherein the massive support comprises two lateral inclined edges which are divergent towards the end edge of the barrel.

8. A sparking-plus according to claim 1, wherein said massive support defines an apperture in the region of an outer end of the centre electrode.

9. A sparking-plug according to claim 1, wherein said massive support constitutes a cold wall which extends in confronting relation to the nose of the insulator and to an end portion of the centre electrode throughout lengths thereof which are adapted to project into the combustion chamber.

* * * * *